United States Patent [19]

MacDonald, deceased et al.

[11] Patent Number: 4,662,571

[45] Date of Patent: May 5, 1987

[54] MINERAL IMPACT BREAKING APPARATUS

[76] Inventors: George J. MacDonald, deceased, late of Khandallah, Wellington; by Evelyn M. H. MacDonald, exectrix, 8 Mathieson Avenue, Khandallah, Wellington; Bryan A. Bartley, 625 Mt Eden Road, Mt Eden, Auckland, all of New Zealand

[21] Appl. No.: 414,182

[22] Filed: Sep. 2, 1982

[30] Foreign Application Priority Data

Sep. 8, 1981 [NZ] New Zealand ..... 198307

[51] Int. Cl.[4] ..... B02C 19/00

[52] U.S. Cl. ..... 241/81; 241/275; 241/284

[58] Field of Search ..... 241/81, 5, 275, 152 A, 241/152 R, 26, 40, 30, 284

[56] References Cited

U.S. PATENT DOCUMENTS

| | | | |
|---|---|---|---|
| 2,012,694 | 8/1935 | Runyan | 241/275 X |
| 2,226,330 | 12/1940 | Symons . | |
| 2,468,321 | 4/1949 | Bland | 241/275 X |
| 2,707,314 | 5/1955 | Horth . | |
| 2,992,784 | 7/1961 | Behnke et al. . | |
| 3,429,511 | 2/1969 | Budzich | 241/284 X |
| 3,782,643 | 1/1974 | Carpenter, Jr. . | |
| 3,788,562 | 1/1974 | Greenlay et al. . | |
| 3,834,631 | 9/1974 | King . | |
| 3,970,257 | 7/1976 | MacDonald et al. . | |
| 3,995,784 | 12/1976 | De Los Santos Izquierdo . | |
| 3,995,814 | 12/1976 | Alberts . | |

FOREIGN PATENT DOCUMENTS

| | | | |
|---|---|---|---|
| 943389 | 5/1956 | Fed. Rep. of Germany . | |
| 2122568 | 9/1972 | France . | |
| 376760 | 7/1932 | United Kingdom | 241/275 |
| 462588 | 3/1937 | United Kingdom . | |

*Primary Examiner*—Mark Rosenbaum
*Attorney, Agent, or Firm*—Ladas & Parry

[57] ABSTRACT

Mineral impact breaking apparatus uses a divided flow with the first part of the flow being accelerated preferably through a rotor and discharged towards an impact breaking surface. The second part of the mineral flow is introduced into the path of the accelerated first part of the flow so that there is impacting between the first and second flows of minerals and with the second flow acting as anvil blocks against which the first flow particles will be impacted and broken. Where the horizontal accelerating rotor is used to accelerate the first part of the mineral flow the kinetic energy of the rapidly rotating air above the rotor is used to direct an air flow back to the infeed of the rotor and minimize dust discharge.

14 Claims, 4 Drawing Figures

MINERAL IMPACT BREAKING APPARATUS

This invention relates to impact breaking apparatus designed to reduce the size of minerals removed from mines, quarries or alluvial deposits.

BACKGROUND TO THE INVENTION

The production of minerals from the earth's crust almost always involves size reduction between mining or quarry extractions and final preparation of the product. There are many varieties of machines made for crushing minerals and rock. The present invention is concerned with the impact type crusher. The basic principal is that the rotor accelerates the mineral particles against an impact surface.

It has been recognized that some advantages can be gained by placing the accelerating rotor or distributor horizontally and feeding vertically and centrally into such a distributor and impacting against a circular line chamber.

The present invention has particular applicability with the rotary impact breaker as disclosed and claimed in U.S. Pat. No. 3,970,257. Normally there are two exit ports in the rotor and these are protected by tungsten carbide tip plate.

With any mineral breaker it is desirable to improve the output relative to the amount of energy used. It is also desirable to vary the product grade and to have a measure of control of the breaking forces comparative to the characteristic of the particular material or mineral being reduced in size. For instance, the size, density, shape, roughness, stickiness, electrical or magnetic susceptibility are all characteristics which could be relevant. Also with impact breakers it is desirable to have an air flow characteristic which will minimize dust emission.

THE PRESENT INVENTION

The present invention is intended to provide a rotary impact mineral breaker which will increase the efficiency by improving output without significantly increasing power demand. The invention is also concerned with the control of the air movement inside the rotary impact breaker to minimise dust emission.

Broadly the invention consists in rotary impact breaking apparatus comprising a driven accelerating rotor which accelerates a flow of minerals to be broken, first mineral feed means to feed minerals to said accelerating rotor for the minerals to be accelerated towards an impact face, an impact face against which the accelerated minerals impact and second mineral feed means to feed a secondary flow of minerals into the path of the minerals accelerated by the accelerating rotor before impact against the impact means whereby the secondary flow of minerals can be struck by the accelerated first flow of minerals.

DRAWING DESCRIPTION

Figure 1:
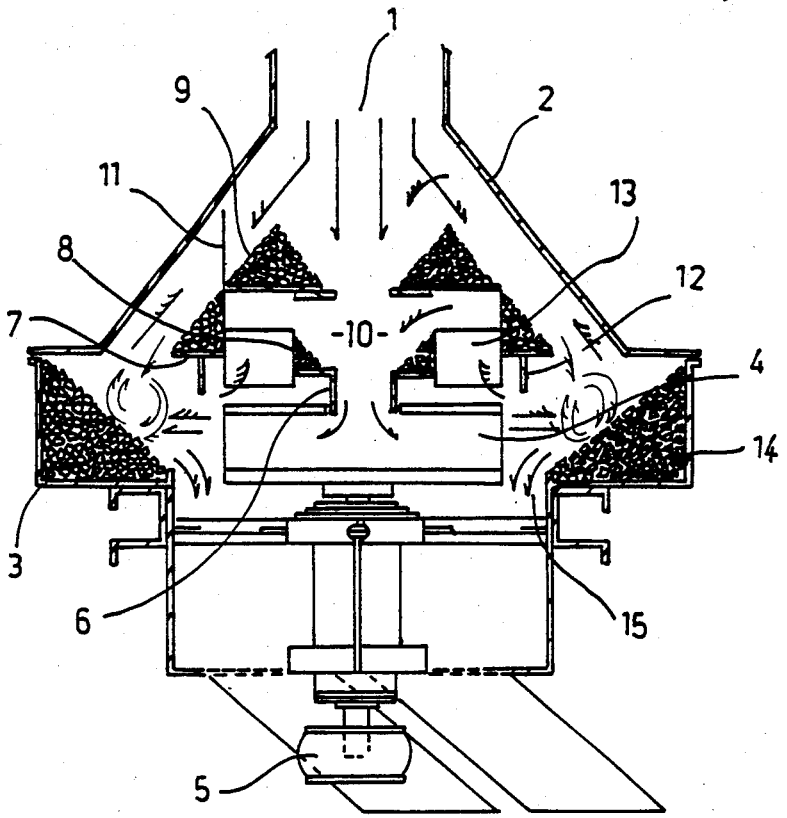
Figure 2:
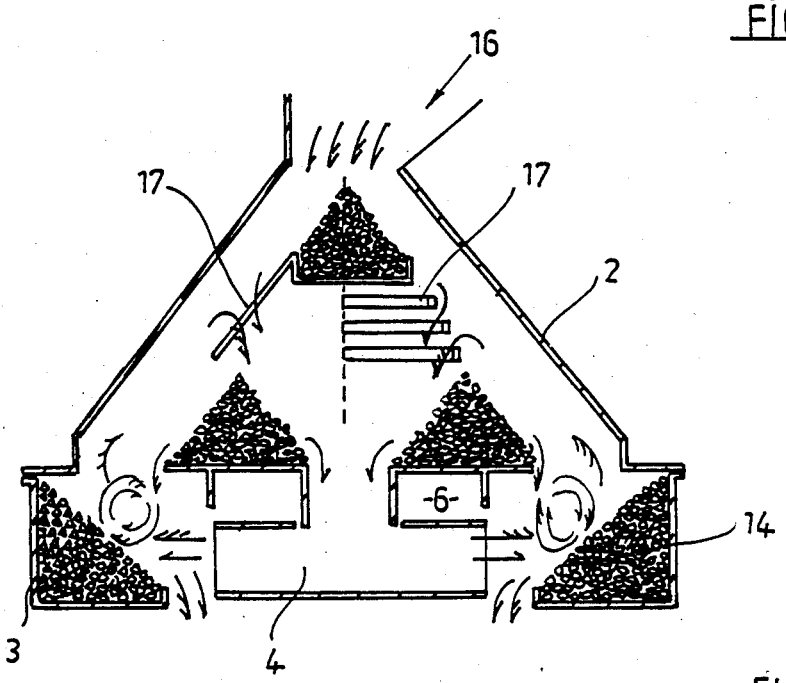
Figure 3:
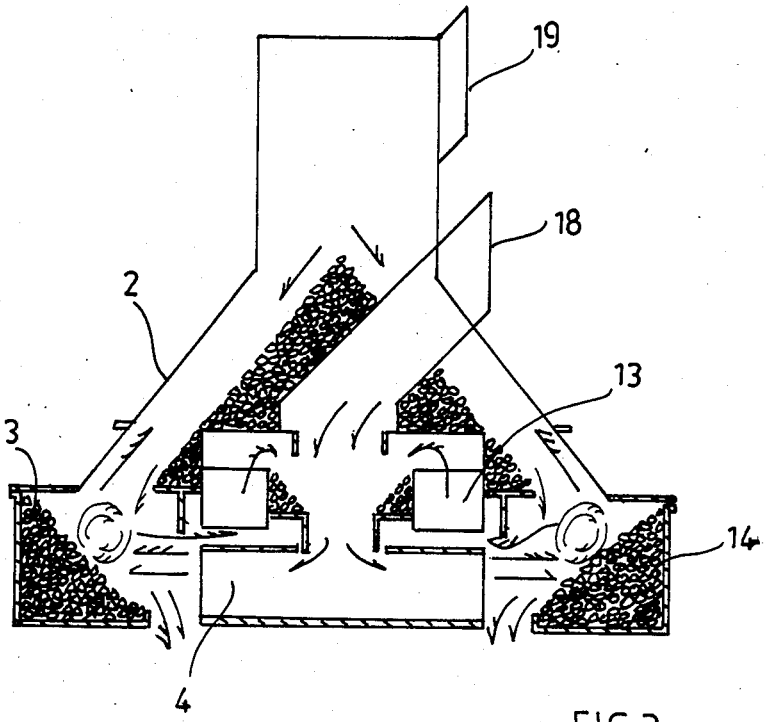
Figure 4:
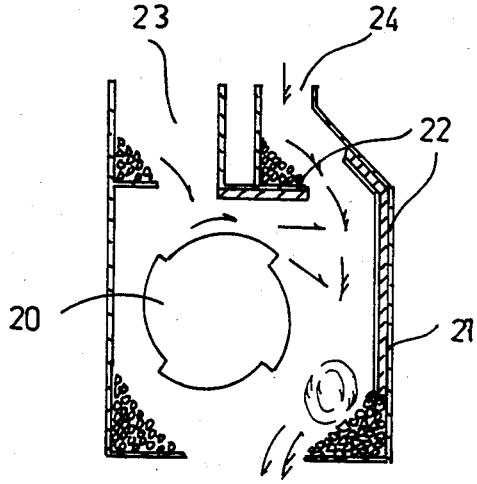

One preferred form of the present invention will now be described with reference to the accompanying drawings in which:

FIG. 1 is a diagrammatic view through material breaking apparatus according to the present invention, FIG. 2 is a modified form of the apparatus as shown in FIG. 1, FIG. 3 is a yet further modified form of the invention as shown in FIG. 1, and FIG. 4 is an alternative mode of the invention employing a different rotor.

PREFERRED EMBODIMENT

The apparatus according to the present invention has an inlet hopper 1 above an upper casing 2 which is removable from a lower casing 3. A rotor 4, for example a rotor as disclosed in U.S. Pat. No. 3970257, is rotatably mounted within the casing 3 and is driven by drive means 5 usually an electric motor or internal combustion engine.

Above the rotor 4 is a feed tube 6 surround feed plate 7, feed hopper 8, rotor feed control plate 9 and control gate 10 all supported by supports 11 secured to the inside of the upper casing 2.

A drop ring 12 is fitted to the underside of the surround feed plate 7 to prevent random material from reaching the top of the rotor. Air transfer veins 13 are fitted at an angle facing into the direction of circulating air above the rotor to scoop air up into the feed hopper 8 and thereby prevent air being drawn to the rotor from outside the machine via the hopper 1.

In operation the feed material enters the inlet hopper 1 and falls onto the rotor feed control plate 9 where some material forms a ring batter around the control gate 10. Further material arriving from the inlet hopper 1 can continue through the control gate 10, the opening of which is set to allow sufficient material to fall through to the rotor to utilise the power available from the driving means.

Material that passes through the control gate 10 forms a small ring batter in the feed hopper 8 around the top of the feed tube 6. Further material drops down the feed tube 6 and enters the rotor which is being rotated by the drive means and accelerates the material in a near horizontal direction till it is ejected through ports in the perimeter wall of the rotor.

The first material ejected falls on the floor of the lower casing 3 where a main breaking batter 14 of material builds up. Once this batter has reached a stable angle further material that is ejected from the rotor falls circumferentially around the batter and thence downward to the discharge annulous 15 from which it drops to a removal means usually a belt conveyor.

When more material is arriving at the rotor feed plate 9 than can flow through the control gate 10 the surplus flows down the outside of the ring batter and over the edge of the rotor feed control plate 9. It continues down to form a small batter on the surround feed plate 7 and following material drops with low velocity into the main breaking batter 14 which defines an impact zone through which the material drops substantially unimpeded where it can be struck by material that has been accelerated and ejected in the near horizontal direction by the rotor. Both the rotor feed material and the surround feed material mix with multiple collisions on the main breaking batter and flow downwards through the discharge annulous 15 to the removal means.

The rotor also accelerates air with the result that there is a flow from the feed hopper 8 via the feed tube 6 rotor 4 out into the lower casing 3. Unless the air is directed back to the feed hopper it would be discharged from the machine and a dust nuisance could result. Air transfer veins 13 are fitted to use the kinetic energy of the rapidly rotating air above the rotor to send it back to the feed hopper. Additionally there is a direct connection from the relatively high pressure area near the main breaking batter 14 to the inlet hopper 1 so that a supply of air is available to flow through the control gate 10 of the feed hopper 8 without drawing air from the outside of the machine through the inlet hopper entry.

This arrangement enables the feed rate to the machine to be increased by the amount that flows directly to the surround without additional power or wear demands on the rotor. Because the surround feed material is struck by the material accelerating in the rotor it is reduced and shape improved thus adding to the quantity of product with little extra cost. The power to end product ratio is thereby significantly improved.

The modification in FIG. 2 shows a single feed entry 16 an the division of the feed material is made within the upper casing 2 by a radial screen 17 which directs those particles above the size that is acceptable in the rotor to the surround. A screen provided by a series of concentric rings or tubes 17*a* may be used in place of the radial screen 17 if desired. Usually this system would be used in a closed circuit so that oversized material which was not reduced in the first pass would be recycled for processing again.

The facility enables larger particle sized material to be processed without increasing size or stresses in the rotor, shaft or bearings and at the same time increases the quantitiy of the product.

The modification in FIG. 3 shows an inlet 18 for the rotor feed and inlet 19 for the surround feed. This division is made external of the machine by screening or other separation means appropriate to the characteristic of the material by which the division is to be made. The feeds can be brought to the machine by conveyor or chute means. This facility enables variations in grading, scrubbing and differential crushing or breaking to be achieved.

The modification shown in FIG. 4 represents an impact crusher with a horizontal shaft and rotor 20 driven by an appropriate power source (not shown). The casing 21 is lined with breaker blocks 22. The feed of material through the chute 23 falls onto the rotor 20 and is accelerated thereby. This material would normally strike against the breaker blocks 22. The secondary feed through chute 24 falls into the path of the accelerated material and there are multiple collisions between the relatively low velocity material falling through the chute 24 and the accelerated material leaving the rotor. This results in improved throughput of the machine and protects the breaker blocks to some extent from wear which would otherwise occur as a consequence of impact by the accelerated material from the rotor.

It will be appreciated that the present invention embodying the divided feed principal whereby the rotor is used as an accelerating means to accelerate the primary feed material to strike the secondary flow can be applied to vertical spindle impact crushers of all types and the present preferred embodiments relative to the particular rotors discloses are intended as examples only.

It should also be noted that the casing can be of any convenient section and it may be circular, square or it may be multi-sided. Flows of surround material may be continuous all around the rotor or several separate streams. The control gate used to regulate the flow to the rotor can be at any particular location and indeed it would be preferable to ensure that there is a means whereby both the rotor flow and the surround flow can be controlled.

The shape of the rotor feed control plate and surround feed plate can also be circular, square, multi-sided or scalloped.

The relative rates of the flow through the rotor and to the surround areas will be varied. However it is considered for optimum operation the rotor flow should approach the feed which can conveniently be handled by the power available to rotate the rotor and a flow substantially in excess of that flow would normally be fed to the surround. The anticipated surround flow to rotor flow ratio would range from 1 to 1 to 4 to 1 but in certain circumstances there may well be ranges outside those given and it is not intended that these ranges should be limiting in any way but merely illustrative.

In the drawings the arrow which one barb indicates the first or rotor flow material path, the arrow with two barbs the secondary material path and the arrow with three barbs the recirculating air path.

The following tests results indicate the improved efficiency possible using the present invention.

TEST 1

A mineral breaker substantially as illustrated in FIG. 1 was operated but with the flow of minerals massing through the rotor only. The flow rate through the rotor was 30 tonnes per hour. The production of sand of −4.75 mm was 5 tonnes per hour. Their was no sand in the feed stones.

Test 2

The flow through the rotor remained at 30 tonnes per hour. The flow on the outside of the rotor was 100 tonnes per hour giving a total feed of 130 tonnes. The production of sand of −4.75 mm was 18 tonnes per hour. Once again there was no sand in the feed stone. The power consumption for Test 2 was substantially the same as the power consumption for Test 1.

Over a series of similar tests varying the feed in the second flow between 85 and 115 tonnes per hour and retaining the through-put through the rotor at a constant 30 tonnes per hour the mean production of sand with a −4.75 mm diameter was 14 tonnes per hour.

What is claimed is:

1. Rotary impact breaking apparatus comprising:

(a) a driven accelerating rotor which accelerates a flow of minerals to be broken, (b) first mineral feed means to feed minerals to said accelerating rotor, (c) mineral bed retaining means on which an impact face of minerals is built up in use, (d) second mineral feed means at a low velocity to feed a secondary flow of minerals into the path of the minerals accelerated by said accelerating rotor before impact against the impact face said secondary flow being substantially all in a region adjacent said impact face, (e) and a discharge means from said mineral bed retaining means, said accelerated flow of minerals and said low velocity of minerals thereby cooperating to densify the amount of minerals at said region adjacent said impact face causing multiple collisions between the accelerated minerals and the low velocity minerals at said region.

2. Apparatus as claimed in claim 1 wherein the accelerated first flow of minerals meets the second flow of minerals substantially at right angles and the ratio of the first flow of mineral material to the second flow of mineral material is in a range of from 1 to 1 to 1 to 4.

3. Apparatus as claimed in claim 1 wherein said rotor comprises a vertically mounted rotor designed to catch the first flow of minerals on the rotating periphery thereof and accelerate the minerals about a section of the periphery with the accelerated minerals delivered towards said impact face of minerals.

4. Apparatus as claimed in claim 1 wherein said rotor comprises a horizontally mounted rotor adapted to receive the mineral feed substantially in the region of the centre thereof and to accelerate the minerals through one or more paths towards the circumference of the rotor with the accelerated minerals being delivered outwardly from the rotor towards a retained bed of mineral material located around the periphery of the rotor.

5. Apparatus as claimed in claim 4 wherein a rotor feed control plate is located above the rotor with a central aperture therethrough directing a flow of minerals to the rotor and with the excess minerals being caused to pass over the outer periphery of the rotor feed control plate to establish the secondary flow of minerals.

6. Apparatus as claimed in claim 5 wherein a control gate is associated with the aperture through the rotor control plate, said control gate being adjustable to vary the amount of minerals feeding into the rotor.

7. Apparatus as claimed in claim 4 wherein a feed tube is associated with the infeed to the rotor and is dependent from a feed plate arranged to receive the first flow of minerals.

8. Apparatus as claimed in claim 4 wherein screen means are positioned above the rotor with said screen means adapted to cause the smaller mineral pieces to be passed into the infeed of the rotor and the larger mineral pieces to pass down as the second flow.

9. Apparatus as claimed in claim 8 wherein said screen means comprise a plurality of radial finger bars over which the mineral material is caused to pass.

10. Apparatus as claimed in claim 8 wherein said screen comprises a plurality of one of concentric bars and rings over which the material is caused to pass.

11. Apparatus as claimed in claim 4 wherein air transfer vanes are fitted above the rotor to use the kinetic energy of the rapidly rotating air above the rotor to direct a flow of air back to the feed hopper feeding the rotor.

12. Apparatus as claimed in claim 4 wherein the casing defining the chamber holding the rotor and feed means therefor is sufficiently large to accommodate the secondary flow of minerals and allow for a back pass of air from the impact zone to the inlet to the housing again tended to reduce the discharge of dusty air from the machine.

13. Apparatus as claimed in claim 4 wherein two separate mineral flows are provided, one being delivered to the rotor feed and the other being delivered to discharge into the impact zone of the material being accelerated by the rotor.

14. Apparatus as in claim 1 wherein the secondary flow of minerals is substantially in excess of the first mineral feed flow.

* * * * *